US006585252B1

(12) United States Patent
Russo et al.

(10) Patent No.: US 6,585,252 B1
(45) Date of Patent: Jul. 1, 2003

(54) SEMI-ACTIVE CLUTCH ASSEMBLY

(76) Inventors: Jim T. Russo, 185 Kathleen La., Chicago, Heights, IL (US) 60411; John V. Schiralli, 295 W. Trail Dr., Grayslake, IL (US) 60030; Paul E. Brodzik, 23076 N. Richards Ct., Prairie View, IL (US) 60069; Jose S. Pioquinto, 520 Balmoral Dr., Mundelein, IL (US) 60060

( * ) Notice: Subject to any disclaimer, the term of this patent is extended or adjusted under 35 U.S.C. 154(b) by 84 days.

(21) Appl. No.: 09/724,573

(22) Filed: Nov. 28, 2000

Related U.S. Application Data

(63) Continuation-in-part of application No. PCT/US00/05540, filed on Mar. 2, 2000.

(51) Int. Cl.[7] ..... B65H 3/06
(52) U.S. Cl. ..... 271/122; 271/125
(58) Field of Search ..... 271/122, 125

(56) References Cited

U.S. PATENT DOCUMENTS

| | | | | |
|---|---|---|---|---|
| 3,640,524 A | | 2/1972 | Fredrickson | 271/36 |
| 3,709,482 A | | 1/1973 | Nelson et al. | 271/37 |
| 3,754,754 A | * | 8/1973 | Peterson | 271/122 |
| 3,885,782 A | | 5/1975 | Wright et al. | 271/10 |
| 3,937,453 A | | 2/1976 | Hickey et al. | 271/4 |
| 4,113,245 A | | 9/1978 | Colglazier et al. | 271/10 |
| 4,126,305 A | | 11/1978 | Colglazier et al. | 271/120 |
| 4,306,713 A | | 12/1981 | Avritt et al. | 271/37 |
| 4,368,881 A | * | 1/1983 | Landa | 192/126 |
| 4,436,298 A | | 3/1984 | Donner et al. | 271/10 |
| 4,696,462 A | | 9/1987 | Tanaka et al. | 271/10 |
| 4,822,021 A | | 4/1989 | Giannetti et al. | 271/35 |
| 4,844,435 A | | 7/1989 | Giannetti et al. | 271/10 |
| 4,982,942 A | | 1/1991 | Konishi et al. | 271/119 |
| 5,006,903 A | | 4/1991 | Stearns | 355/308 |
| 5,007,627 A | | 4/1991 | Giannetti et al. | 271/35 |
| 5,039,080 A | | 8/1991 | Kato et al. | 271/122 |
| 5,062,599 A | | 11/1991 | Kriegel et al. | 271/35 |

(List continued on next page.)

FOREIGN PATENT DOCUMENTS

| | | | |
|---|---|---|---|
| EP | 0 575 919 A1 | 12/1993 | |
| FR | 2 378 706 | 8/1978 | |
| JP | 0006854 | 1/1983 | |
| JP | 01117142 | 5/1989 | |
| JP | 0181633 | 7/1989 | |
| JP | 0081845 | 3/1990 | |
| JP | 03003839 | 1/1991 | |
| JP | 03223043 | * 10/1991 | 271/121 |

OTHER PUBLICATIONS

Copiscan 4000 Series, The Copiscan 4040D plus high performance production capabilities on every workgroup desktop. Bell & Howell Scanner Division, 1997 Bell & Howell Scanner Division.

Fallon, et al., "Sheet Feeding Apparatus," IBM Technical Disclosure Bulletin 19(7):2440–2441 (Dec. 1976).

*Primary Examiner*—Christopher P. Ellis
*Assistant Examiner*—Mark A. Deuble
(74) *Attorney, Agent, or Firm*—McDermott, Will & Emery

(57) ABSTRACT

The invention is a sheet feeder including a skimmer and a separator. The separator is designed for advancing the engaged sheet while separating any adjacent sheets. In one embodiment, the separator has a driven infeed roller nipped with a drag or separator roller. The separator roller also includes a recoil mechanism. The drag normally slips and permits the separator roller to be driven forward by the infeed roller, which cocks the recoil mechanism, then allows the infeed roller to advance a sheet. The separator roller recoils backward when a multifeed of two or more sheets is engaged between the advancing and separator rollers. The sheet separator can have as its sheet-engaging member a roller sleeve. The roller sleeve can be axially slidable on the rotatable element for ready installation on and removal from the rotatable element.

9 Claims, 6 Drawing Sheets

U.S. PATENT DOCUMENTS

| | | | | | |
|---|---|---|---|---|---|
| 5,106,071 | A | | 4/1992 | Graham | 271/116 |
| 5,190,277 | A | | 3/1993 | Rahman et al. | 271/35 |
| 5,209,464 | A | | 5/1993 | Bermel et al. | 271/35 |
| 5,344,134 | A | | 9/1994 | Saeki et al. | 271/122 |
| 5,386,913 | A | | 2/1995 | Taylor | 209/583 |
| 5,416,570 | A | | 5/1995 | Kondou | 355/321 |
| 5,435,538 | A | * | 7/1995 | Billings et al. | 271/122 |
| 5,472,182 | A | | 12/1995 | Han | 271/3.13 |
| 5,474,287 | A | | 12/1995 | Takahashi | 271/10.13 |
| 5,497,250 | A | | 3/1996 | Kawashima | 358/498 |
| 5,502,556 | A | | 3/1996 | Yamada | 355/320 |
| 5,510,909 | A | | 4/1996 | Morikawa et al. | 358/498 |
| 5,532,847 | A | | 7/1996 | Maruyama | 358/498 |
| 5,547,179 | A | | 8/1996 | Wilcox et al. | 271/3.2 |
| 5,564,689 | A | * | 10/1996 | Fukube | 271/122 |
| 5,568,281 | A | | 10/1996 | Kochis et al. | 358/475 |
| 5,570,876 | A | | 11/1996 | Samii | 271/119 |
| 5,574,274 | A | | 11/1996 | Rubley et al. | 250/208.1 |
| 5,598,271 | A | | 1/1997 | Ohtani | 358/296 |
| 5,610,731 | A | | 3/1997 | Itoh | 358/496 |
| 5,638,181 | A | | 6/1997 | Kubo et al. | 358/296 |
| 5,673,124 | A | | 9/1997 | Kaji et al. | 358/474 |
| 5,680,204 | A | | 10/1997 | Ferrara | 355/311 |
| 5,689,765 | A | | 11/1997 | Nishinozono | 399/81 |
| 5,692,743 | A | | 12/1997 | Yano et al. | 271/121 |
| 5,705,805 | A | | 1/1998 | Han | 250/204.1 |
| 5,710,967 | A | | 1/1998 | Motoyama | 399/377 |
| 5,715,500 | A | | 2/1998 | Nakazato et al. | 99/124 |
| 5,734,483 | A | | 3/1998 | Itoh | 358/496 |
| 5,760,412 | A | | 6/1998 | Yang et al. | 250/559.4 |
| 5,769,412 | A | | 6/1998 | Takemoto et al. | 271/188 |
| 5,897,258 | A | | 4/1999 | Wen et al. | 400/579 |
| 5,921,539 | A | | 7/1999 | Westcott et al. | 271/10.03 |
| 6,042,099 | A | | 3/2000 | Takagishi | 271/2 |

* cited by examiner

SEMI-ACTIVE CLUTCH ASSEMBLY

CROSS-REFERENCE TO RELATED APPLICATIONS

This application is a continuation-in-part of International Application No. PCT/US00/05540, filed Mar. 2, 2000, designating the United States of America and other countries, now pending. Other related, recent applications filed by the same assignee are U.S. Ser. Nos. 09/262,768 and 09/262,770, filed Mar. 4, 1999, now pending. Each application listed in this paragraph is hereby incorporated herein by reference.

STATEMENT REGARDING FEDERALLY SPONSORED RESEARCH OR DEVELOPMENT

Not Applicable.

BACKGROUND OF THE INVENTION

The present invention relates to automated sheet feeder apparatus for scanning equipment and the like, and more particularly to a configuration that facilitates document separation and spacing for use with universal document feeder apparatus associated with high-speed image scanning equipment requiring a high-volume document throughput.

Automated high-speed image scanning equipment utilizes an imaging device to scan the images from an input or source document. Such equipment must feed and transport documents to the imaging device quickly, smoothly, and automatically, and must be trouble-free. The feeding equipment must quickly and smoothly feed each original document or individual sheet from the backlog queue of input or source documents waiting to be scanned to the transport apparatus. The transport apparatus then brings each document or sheet to the imaging device. To achieve high-volume throughput, the high-volume feeder apparatus must be able to supply the individual documents or sheets in a spaced relationship to the input section of the transport apparatus in a manner that is completely reliable and trouble-free.

A problem associated with high-speed image scanning equipment found in the prior art is that the individual source or input documents commonly are not standardized. They vary in shape and size, and come in a variety of different thicknesses (e.g., sheets ranging from an onionskin thickness to thick card stock). This mandates that each non-uniform document be processed or handled in a uniform manner.

Another related problem is that, in the majority of instances, the input or source document is an original document or a document that is not easily replaced. It becomes imperative that the document feed mechanism not damage any of the source documents under any circumstances.

A persistent problem found in the prior art is the more or less random feeding of multiple documents at one time by the document feed mechanism, rather than a single sheet. The problem is commonly referred to, by those skilled in the art, as the "multi-feeds" problem. The multi-feeds problem is made even more critical when a high-volume document throughput is required for high-speed image scanning equipment and the like. In such situations, the individual source documents waiting to be scanned are in a stack, and either the top or bottom document is fed sequentially to the image scanner by the document feed mechanism.

Several factors have been blamed for this negative result. One such factor is the weight of the skimmer roller assembly (which rests on top of the first document in the stack of documents waiting to be scanned). Another such factor is the underlying dynamics of the friction that the bottom and top sheets experience as the document feed mechanism accelerates the next sheet from the stack forward. Yet another such factor is the spacing required between individual documents as documents enter the document feed mechanism and are sequentially processed.

Yet another common problem with certain document feed mechanisms for high-speed image scanning equipment and the like found in the prior art is that, over time, this equipment will occasionally cause bottlenecks and/or jam-ups of downstream equipment, having an obvious negative effect on overall document throughput. Sometimes the problem can be corrected by timely maintenance of the document feed mechanism. High-speed image scanning equipment that provides for high-volume document throughput necessitates a reliable document feed mechanism that is easy to maintain and is capable of fulfilling document throughput requirements.

A particular prior device currently in use employs a relatively narrow skimmer roller at the entrance to the feeder together with an adjustable separate weight that helps the skimmer roller to grip the paper. The prior device also uses a pair of counter-rotating shafts with interleaved roller portions that are designed to advance the top page while separating any adjacent or lower pages. The counter-rotating shafts are set an adjustable distance apart. The inventors have found that this arrangement results in paper jams and multifeeds when stacks of documents with different thicknesses are introduced. Finally, in that device there is space between the skimmer roller and the interleaved forwarding and separator rollers. Sheets being fed sometimes buckle or bunch up in that space.

Another prior device currently in use utilizes a driven infeed roller nipped with a separator roller coupled by a drag and recoil mechanism to a fixed shaft. The infeed roller urges one face of the sheet forward, while the separator roller acts as a drag on the opposite face of the sheet. If multiple sheets pass between the advancing and the separator rollers, the infeed roller will urge the first sheet forward and the separator roller will drag on the other sheet. Since the friction between the separator roller and the sheet is higher than the friction between two sheets, the separator roller will prevent the passing of the lower sheet. While this is not a "reversing" roller per se, but rather a simple "drag" on the lower of two adjacent sheets, it tends to separate the two while the upper sheet passes through the gap under the drive of the infeed roller.

Also in the prior art are various arrangements for the separator roller. The first of these is an earlier development in which a separator roller is mounted on a fixed shaft and has a peripheral rubber surface that frictionally engages the peripheral outer surface of the infeed roller or the sheet between the rollers. A tubular coil spring is attached at one end to the separator roller and wrapped around the fixed shaft. When the infeed roller moves in the forward direction, the friction between the outer surfaces of the separator and infeed rollers urges the separator roller forward, thus tending to turn the coil spring on the fixed shaft. This torsion tensions the coil spring. When more than one sheet is passed between the rollers, the infeed roller pushes the top sheet in the forward direction. The separator roller is uncoupled from the infeed roller, as two or more fed sheets between the advancing and separator rollers slip relative to each other. Uncoupling the rollers allows the spring to unwind. The unwinding spring momentarily turns the separator roller backward for about one revolution. An example of this mechanism can be found in Bell & Howell's Scanner Model Nos. 0101276 and 0101300.

BRIEF SUMMARY OF THE INVENTION

The invention is a sheet feeder for engaging and removing a sheet of paper or other material from one end of a stack of sheets and feeding the engaged sheet edgewise along a feed path. The improvements of the present invention address the drawbacks and deficiencies of the prior art in a manner that facilitates high-speed image scanning of individual source documents irrespective of the size or thickness of the specific source document being scanned or processed.

One aspect of the invention is a sheet separator for breaking down multifeeds of two or more overlapping sheets into separate sheets. The separator includes a sheet path, an advancing drive, and a sheet separator assembly including a recoil mechanism and a sheet drag.

The sheet path is the path normally followed by sheets going through the sheet separator. The sheet path is arranged to pass multifeeds of at least two sheets. A multifeed is defined as having first and second opposed outside surfaces. The multifeeds are separated as they travel along the sheet path. The advancing drive is positioned to engage and drive the first surface of the multifeed forward along the sheet path.

The sheet separating assembly includes an advancing drive, a separator roller or other rotatable separator element, a recoil mechanism (also known as a sheet return mechanism), a drag, and optionally a roller sleeve. The advancing drive engages and drives the first surface of the multifeed in the feed direction along the sheet path.

The separator element is rotatable by the second surface of the multifeed in the feed direction and also is rotatable in the counterfeed direction. The recoil mechanism accepts rotational energy, as by winding up or otherwise flexing a spring, by lifting a weight, by compressing an enclosed charge of gas, or by some other mechanism, when the separator element is rotated in the feed direction by advancement of the second surface of the multifeed. The accumulated rotational energy biases the separator element to rotate in the counterfeed direction.

The recoil mechanism releases the accumulated energy and rapidly returns the lower sheet or sheets of a multifeed in the counterfeed direction, thus positively retracting at least the bottom sheet of the multifeed, when the multifeed gets between the drive roller and the separator assembly. The drag resists rotation of the rotatable element in the feed direction, thus retarding the progress of at least the bottom sheet of any multifeed.

The roller sleeve has an outer, generally cylindrical surface positioned to frictionally engage and be rotated by the second surface of the multifeed. The roller sleeve has an inner, generally cylindrical surface coupled to the rotatable element. Rotation of the rotatable element is retarded by the drag and the sheet return mechanism, as described above. The net result is that the sheet separator assembly retards the forward progress of the second surface of the multifeed and positively drives the bottom sheet in the reverse direction, while allowing the top sheet defining the first surface of the multifeed to be driven forward without interruption.

The roller sleeve can be axially slidable on the rotatable element for ready installation on and removal from the rotatable element, if desired.

Another embodiment of the invention is a paper drive for engaging and removing a sheet having an exposed surface from one end of a stack of sheets and feeding the engaged sheet edgewise along a feed path. The paper drive includes at least one roller and a freewheeling mechanism.

The roller has a rotation axis. The roller is positioned to drive the outside sheet of a stack forward into the sheet path. The roller is driven in the direction driving a sheet forward into the sheet path. The drive engages the roller through a freewheeling clutch or similar arrangement.

The freewheeling mechanism independently allows the corresponding roller free rotation in the forward direction when the sheet is moving forward faster than the peripheral speed of the roller. The sheet can be moved faster than the roller by later elements along the sheet path, such as a sheet separator or traction rollers. Thus, when the forward end of the sheet reaches a later element operated at a faster speed, the skimmer drive will not resist acceleration of the sheet by the later element.

DETAILED DESCRIPTION OF THE INVENTION

Figure 1:
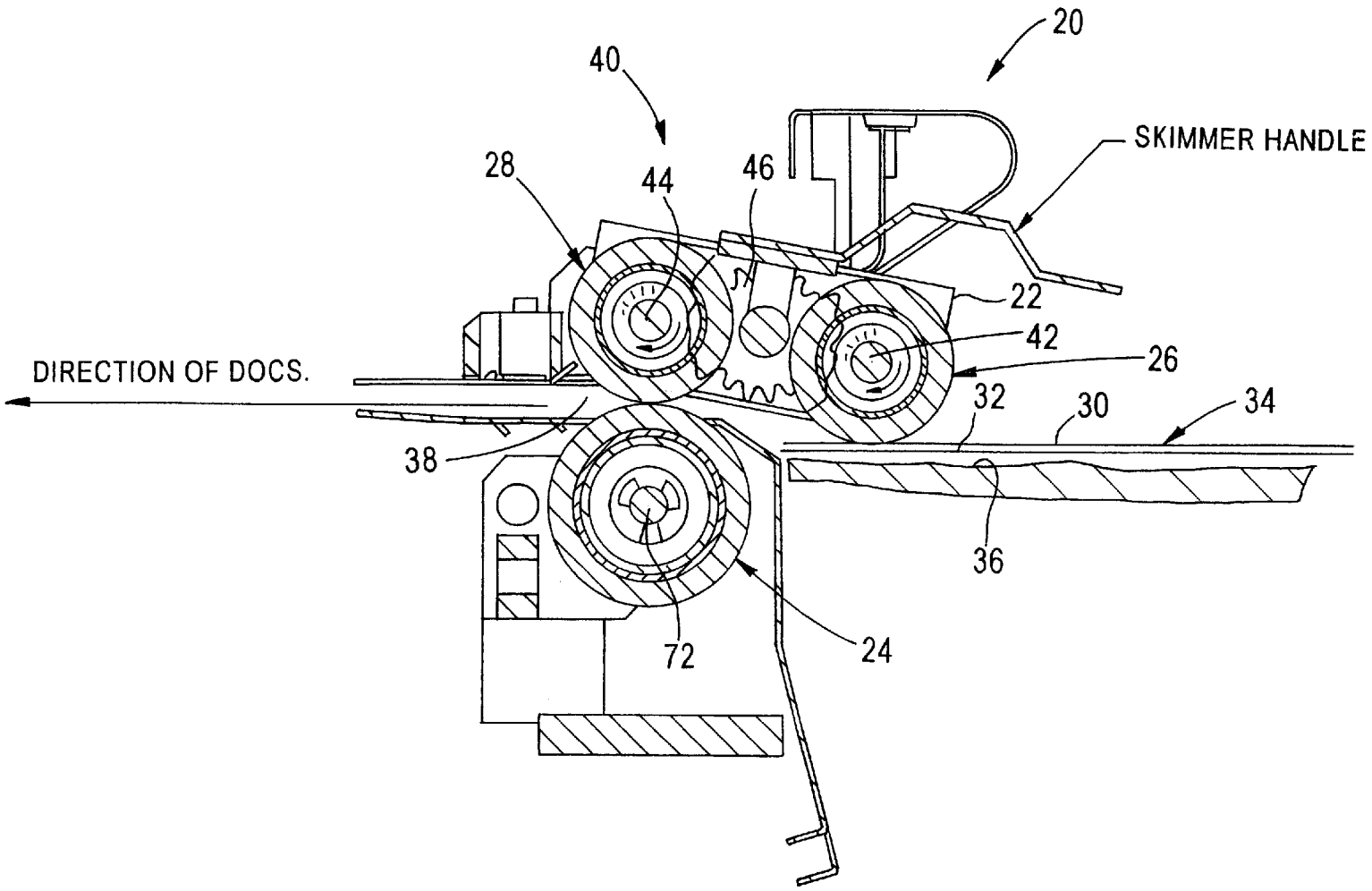
FIG. 1 is a longitudinal section of a document feeder according to one aspect of the present invention.

While the invention will be described in connection with one or more embodiments, it will be understood that the invention is not limited to those embodiments. On the contrary, the invention includes all alternatives, modifications, and equivalents as may be included within the spirit and scope of the appended claims. In the following description and the drawings, like reference numerals represent like elements throughout.

In accordance with the present invention, an improved document feed mechanism is described that facilitates reliable high-volume document throughput for associated image scanning equipment, and similar equipment and/or processes, irrespective of the varying thickness associated with input documents. It is designed to eliminate the feeding of multiple sheets (so-called "multifeeds" of several pages at one time) and to avoid damage to an individual input document or sheet (commonly referred to as "source document").

One suitable environment of the invention is a high speed, commercial document scanner. Scanners of this type typically process continuous streams of paper, like stacks of checks. The scanner has a document imaging assembly and a document feed mechanism. The document feed mechanism would also be useful for feeding sheets of material other than paper from a stack into apparatus for performing any of a wide variety of operations on the sheets.

A typical scanner assembly of this type uses photoelectric detectors and photo imaging devices for digitally capturing the image from a moving piece of paper. The scanner may be capable of single-sided or double-sided image capture. A scanner assembly contains a linear series of charge-coupled devices or the like, which traverse the path of the moving paper. The linear array is repetitively exposed to the light path and digitally "dumped" into memory to reformulate the image electronically in mass memory for display.

Turning to FIG. 1, the illustrated sheet feeder 20 includes a document infeed assembly 22 and a separator roller 24. The infeed assembly 22 includes a skimmer roller 26 and an infeed roller 28. The skimmer roller 26 engages and removes the outside or end sheet 30 from one end of a stack 32 of sheets. The skimmer roller 26 feeds the engaged sheet 30 edgewise along a feed path 34 which extends generally in the plane of the sheet 30 under the skimmer roller 26, along the guide surface 36, and through the nip 38 of the separator generally indicated at 40. The separator 40 is spaced downstream along the feed path 34 from the skimmer roller 26 for advancing the engaged sheet 30 while separating any adjacent sheets mis-fed along with the end sheet 30.

A skimmer shaft 42 supports the skimmer roller 26. It pivots in the vertical direction about the infeed roller shaft 44 to facilitate the insertion of a stack 32 of input or source documents which are positioned on the guide surface 36 for separation and subsequent processing of each individual sheet or source document such as 30. The guide surface 36 can be moved to keep the top sheet or other fed sheet of the stack 32 of source documents at the correct height. This facilitates processing large stacks of documents, as the position of the fed sheet (here, the top sheet) affects feeding ability. Further, each individual input sheet or source document such as 30 in the stack 32 has an associated thickness, which may vary from one such sheet or source document to another.

The infeed assembly 22 includes a drive mechanism 46 for the skimmer roller 26 and the infeed roller 28. In FIG. 1, the only visible element of the drive mechanism 46 is an idler gear. The skimmer roller 26 is carried for rotation about its shaft 42, while the infeed roller 28 is carried for rotation about its shaft 44. The drive mechanism for the rollers 26 and 28 includes gear 48 and 50 respectively fixed to the shafts 42 and 44. The idler gear of the drive mechanism 46 meshes with the gears 48 and 50, allowing the drive mechanism 46 to drive the rollers 26 and 28 in the same direction at the same peripheral speed. The gears could be arranged to drive the infeed roller 28 at a slightly faster peripheral speed than the skimmer roller 26, if desired, to flatten the sheet slightly as it is conveyed.

The skimmer roller 26 and the infeed roller 28 are positioned in tandem. The rollers 26 and 28 are driven together in the direction driving a sheet forward into said sheet path.

In one embodiment, the drive mechanism 46 engages each roller 26 and 28 through a separate freewheeling clutch or similar arrangement. Alternatively, the freewheeling clutch could be used on just one of the rollers, for example the infeed roller 28. Instead of a mechanical freewheeling clutch, an electronically controlled clutch that senses and responds to forward acceleration of the sheet, a ratchet and pawl or other one-way escapement, or other arrangements can be provided. The freewheeling clutch independently allows the corresponding roller free rotation in the forward direction when the sheet is moving forward faster than the drive speed of the roller. The sheet can be moved faster than the drive speed of the roller by later elements along the sheet path, such as a sheet separator or traction rollers. Thus, when the sheet forward end reaches a later element operated at a faster speed, the skimmer and infeed roller drives will not resist acceleration of the sheet by the later element.

Figure 2:
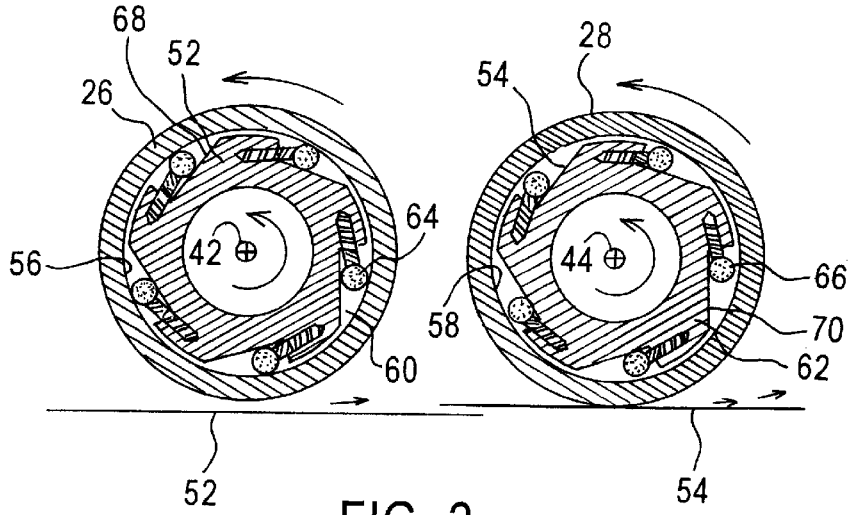
FIG. 2 is a diagrammatic section of the skimmer and infeed rollers shown in FIG. 1, illustrating their internal structure and operation.
Figure 3:
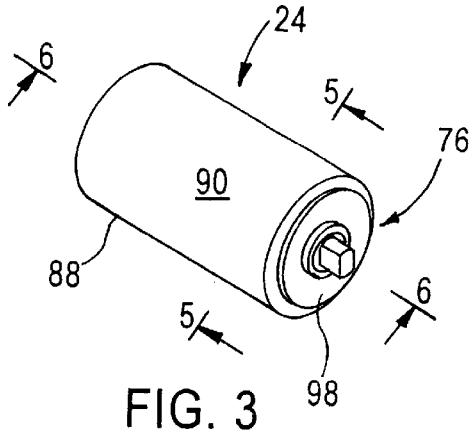
FIG. 3 is an isolated perspective view of an embodiment of the separator roller.

The details of one suitable freewheeling clutch are shown in FIG. 2, which illustrates two ball clutches in the infeed assembly 22 moving the sheets 52 and 54 from left to right. The rollers 26 and 28 are shells defining or fixed to outer races 56 and 58. The outer races 56 and 58 are rotatable with respect to the inner races 60 and 62. The gears 48 and 50 (see FIG. 1) are fixed with respect to the inner races 60 and 62, so driving the gears 48 and 50 drives the inner races 60 and 62. A series of rods or balls (referred to below simply as balls for convenience) such as 64 for the roller 26 (marked as 66 for the roller 28) are captured between the inner races such as 60 and outer races such as 56. The inner races such as 60 include wedge-shaped recesses such as 68 (70 for the roller 28) in which the rods or balls such as 64 are captured. This is a conventional freewheeling clutch, and operates as described below in relation to the sheets 52 and 54 being driven.

FIG. 2 shows the freewheeling clutch for the roller 26 in the engaged or driving position. In this position, the drive 46 rotates the shaft 42, and thus the inner race 60 fixed to the shaft 42, counterclockwise. Since there is no pulling force on the paper sheet 56, and it is merely being passively driven and presents some resistance, the inner race 60 tends to rotate counterclockwise with respect to the outer race 56. This relative movement of the races forces the balls such as 64 into the narrower portions of the recesses such as 68 that are furthest clockwise. The movement of the balls such as 64 into the narrower portions of the wedge-shaped recesses such as 68 jams the outer race 56 and the inner race 60 together, so the drive force on the inner race 60 is transmitted to the outer race 56. To keep the outer races 56 and 58 centered, each clutch has several wedge-shaped recesses such as 68 and captured balls such as 64 around its circumference.

FIG. 2 shows the freewheeling clutch for the roller 28 in the disengaged or freewheeling position. In this position, the drive may continue to rotate the inner race 62 counterclockwise, but the outer race 58 is travelling counterclockwise faster than the inner race 60. This may occur if there is a forward pulling force on the paper sheet 54. This pulling force may be provided, for example, by a later nip with a faster peripheral speed than the normal driven speed of the outer race 58. This relative movement of the races releases the balls such as 66 into the wider, more counterclockwise sides of the recesses such as 70. The wider sides of the recesses such as 70 are wider than the diameters of the balls such as 66. The balls 66 are the only mechanism provided to transmit the driving force from the inner race 62 to the outer race 58. The balls 66 are not in a position to drive the outer race 58, so the outer race 58 turns without any substantial resistance and allows the sheet 54 to be pulled forward.

As soon as the pulling force on the sheet 54 ceases, the inner race 62 again overtakes the outer race 58. The balls such as 66 jam in the recesses such as 70, and the inner race 60 again drives the outer race 56 as shown for the left roller 26 of the infeed assembly 22.

Returning to FIG. 1, the skimmer roller 26 is brought into continuous contact (through gravity) with the topmost document or end sheet 30 of the input stack 32. The feeder could alternately be configured to feed from the bottom of the stack (as to allow additional sheets to be stacked while the sheet feeder is in operation.) In that event, the end sheet would be the bottom sheet of the stack. In the illustrated embodiment the roller assembly 21 desirably bears on the input stack 32 with more force than its own weight provides. An additional weight (not shown) can be provided on the infeed assembly 22 to achieve more positive gripping of the top document of the input stack 32.

The construction of the skimmer roller 26 maintains the correct pressure or force continuously on the top surface of the top sheet or source document 30 of the stack 32 of input documents by the skimmer rollers during operation of the document feed mechanism.

During operation of the document feed mechanism, the skimmer roller 26 makes contact with the top surface of the topmost sheet or source document 30 in the stack 32 waiting to be processed. The skimmer roller 26 will tend to intermittently urge the topmost sheet or source document in the stack of input documents waiting to be processed forward into the document feed mechanism. The plastic or steel (or other similar material) portion of each skimmer roller will tend to act in a manner to facilitate slight slipping on the bottom surface of the topmost document of the stack of input documents.

Returning to FIG. 1, the separator 40 includes a separator roller 24 carried on a shaft 72 and forming a nip 38 with the infeed roller 28. The rollers 24 and 28 are separated slightly at the nip 38. This gap automatically adjusts to maintain a steady nip pressure when sheets of different thickness are fed.

Referring now particularly to FIGS. 3–6, the separator roller assembly is shown as 24. The roller assembly 24 includes a recoil and drag assembly generally indicated as 76. Here, the separator element 76 includes two independently rotatable elements 78 and 80 (see FIG. 4). More or fewer rotatable elements such as 78 can be provided, within the scope of the present invention.

The assembly 24 includes at least one drag 82 defined by internal elements of the separator element 76 operating between its stationary shaft 84 and its rotatable element 78. These internal elements are further described below in connection with FIGS. 5–6. As shown in the Figures, in this embodiment the assembly 24 also includes a second, independent drag 86, also defined by internal elements of the separator element 76 operating between its stationary shaft 84 and its rotatable element 80. Both drags are capable of rotation in the opposite direction under spring force.

Figure 4:
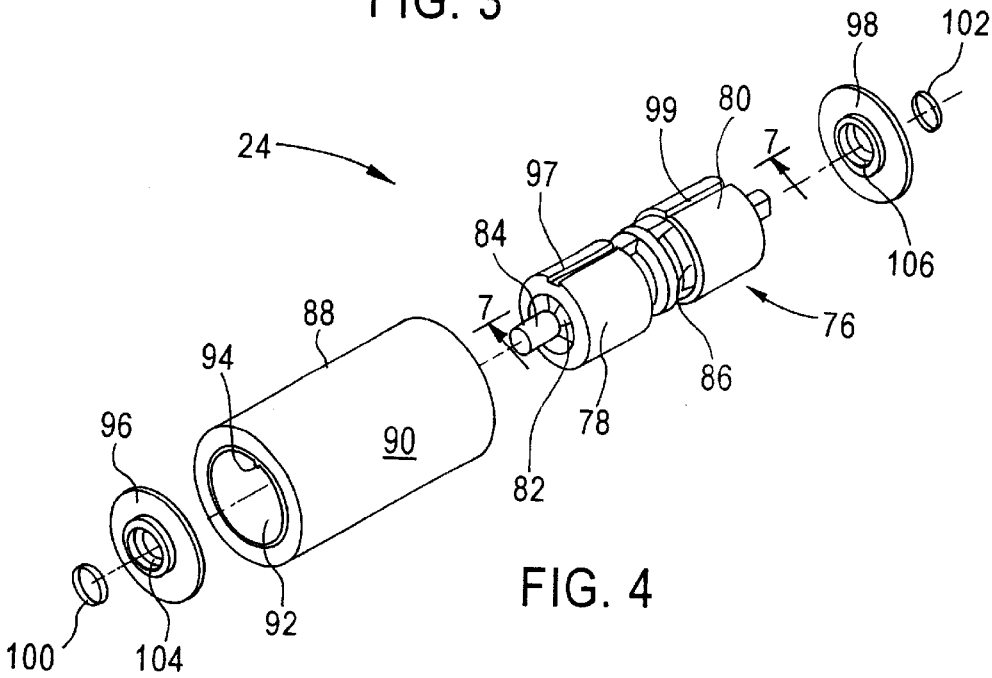
FIG. 4 is an exploded perspective view of the embodiment of FIG. 3.
Figure 5:
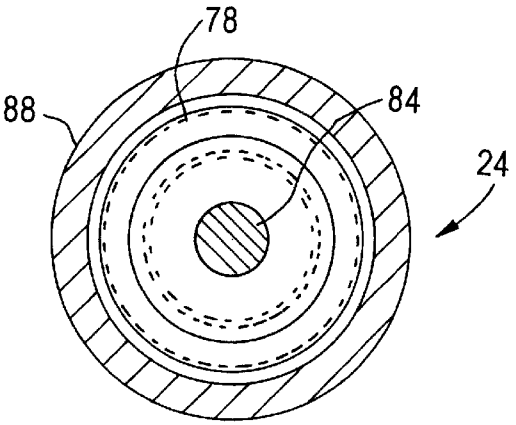
FIG. 5 is a cutaway view taken along lines 5—5 of FIG. 3.
Figure 6:
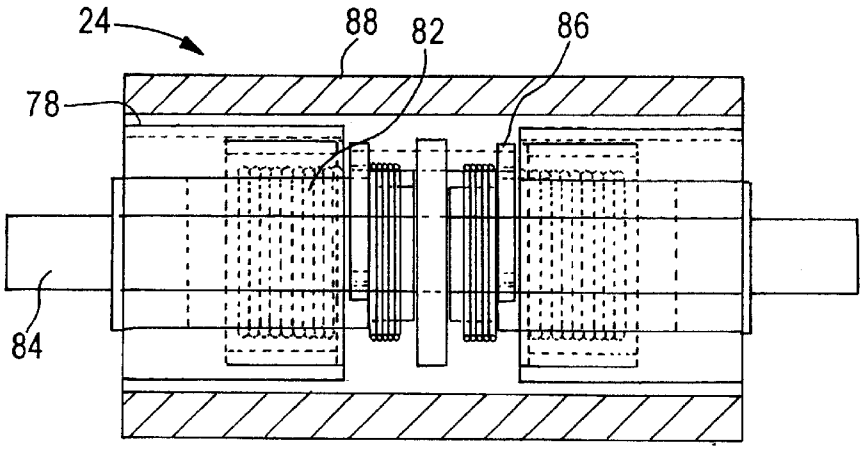
FIG. 6 is a cutaway view taken along lines 6—6 of FIG. 3.

Still referring to FIG. 4, the rotatable elements 78 and 80 are mounted for independent rotation with respect to a normally non-rotating element, here, the shaft 84. The drags 82 and 86 respectively retard rotation of the rotatable elements 78 and 80, providing friction and thus resisting rotation when the rotatable elements 78 and 80 are rotated.

The separator element 76 itself can function as a complete separator roller assembly, with each rotatable element 78 and 80 acting like the separator roller 24 of FIGS. 10–13. To adapt the assembly 76 to this purpose, the rotatable elements 78 and 80 are configured as rollers surfaced with high-friction, resilient, sheet-engaging material. Similar construction has been used commercially for this purpose. In the illustrated embodiment of FIGS. 3–8, however, the rotatable elements 78 and 80 are roller hubs made of machined steel, plastic, or other suitable material.

The separator roller assembly 24 of FIGS. 3–8 further includes a roller sleeve 88. The roller sleeve 88 has an outer, generally cylindrical surface 90 made of a high-friction, resilient material that will frictionally engage the material of the fed sheets. The roller sleeve 88 has an inner, generally cylindrical surface 92 coupled to the hubs 78 and 80.

In this embodiment the coupling between the inner, generally cylindrical surface 92 and the hubs 78 and 80 is provided by a tongue and groove joint. An machined-in integral tongue 94 extends axially along the inner surface 92 of the sleeve 88. The hubs 78 and 80 respectively have mating grooves, 97 and 99. The roller sleeve 88 is axially slidable onto or off of the rotatable elements 78 and 80 for ready installation on or removal from the rotatable elements.

The spacers 96 and 98 center the sleeve 88 during use between the end plates of a bracket (not shown). Polytetrafluoroethylene O-rings 100 and 102 are disposed in the seats 104 and 106, and bear between the shaft 84 and the seats 104 and 106 to center the spacers 96 and 98, providing a low-friction bearing. (TEFLON® is a trademark of E.I. du Pont de Nemours & Co., Wilmington, Del. for polytetrafluoroethylene material.)

One advantage of the tongue-and-groove coupling of the roller sleeve 88 and the hubs 78 and 80 is that, when the outer surface 90 of the sleeve 88 becomes worn or soiled, the assembly 24 can be removed easily. The assembly 24 is lifted out of a fixed bracket on the scanner (not shown). The spacer 96 and 0-ring 100 can be removed, the roller sleeve 88 will slide off, a new roller sleeve 88 will slide on, and the assembly 24 can be reassembled and put in its bracket, all easily and without the need for any tools. If the assembly 24 normally is disposed within a housing, servicing can be further facilitated by providing an access door in the housing surrounding the separator roller 24, opposite one axial end of the assembly 24. Servicing the separator roller assembly 24 can thus be made simple.

Figure 7:
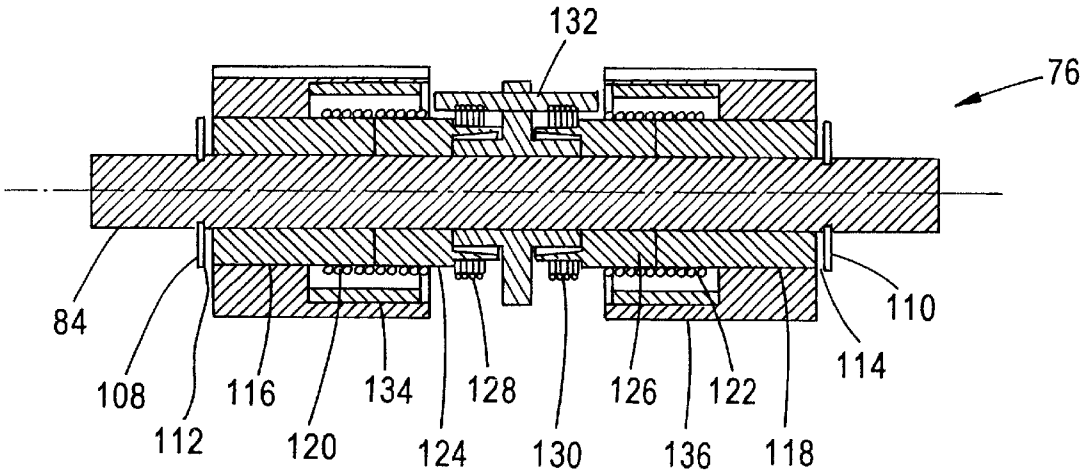
FIG. 7 is an axial section of the separator element taken along lines 7—7 of FIG. 4.
Figure 8:
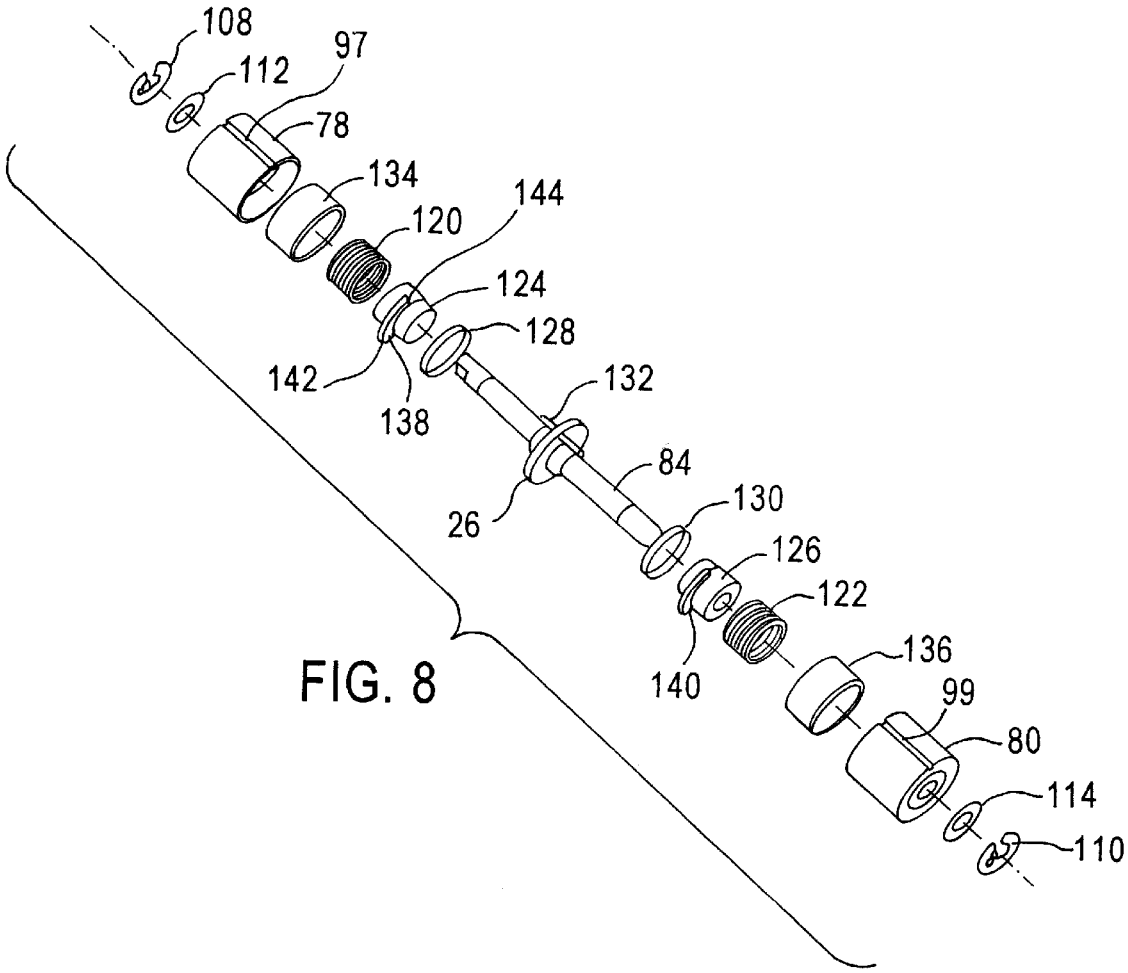
FIG. 8 is an exploded perspective view of the separator element of FIG. 4.

Referring now to FIGS. 7–8, the internal details of the separator element 76 are illustrated. The parts of the assembly 76 shown in FIG. 8 are the shaft 84, two retaining rings 108 and 110, two washers 112 and 114, two hubs 78 and 80, two clutch springs 120 and 122, two reverse spring bodies 124 and 126, two reversing springs 128 and 130, a hub pin 132 and two felt oilers 134 and 136. In the subsequent description, one side of this two-sided structure will be described; the same description applies to the other side as well.

The recoil mechanism of the present invention works as follows. In the assembly 76, the reverse spring body 124 is retained on the shaft 84, and is free to rotate on the shaft 84. The reverse spring body 124 has an integral sector stop 138 (and the spring body 126 has a sector stop 140) including a lower abutment 142 and an upper abutment 144. (These "lower" and "upper" designations are arbitrary, based on the respective positions of the abutments 142 and 144 in FIG. 8).

Either of the lower and upper abutments 142 and 144 can engage the hub pin 132, depending on the rotational orientation of the spring body 126 on the shaft 84. Thus, the reverse spring body 124 can rotate on the shaft 84 within the limits permitted by the abutments 142 and 144 and the hub pin 132.

The reverse or recoil spring 128 is a coil spring retained on the spring body 124. The spring 128 has tangs on its respective ends (not shown). The respective tangs engage the hub pin 132 and a hole in the sector stop 138. The spring 128 biases the lower abutment 142 of the reverse spring body 124 toward and against the hub pin 132. The reverse spring body 124 can be rotated against this bias to the limit at which the upper abutment 144 engages the hub pin 132 by exerting a turning force on the spring body 126.

The clutch spring 120 is another coil spring that bridges between the reverse spring body 124 and the hub 78. The clutch spring 120 has an unstressed inner diameter smaller than the outer diameters of the reverse spring body 124 and the hub 78. When the clutch spring 120 is in place, it is strained sufficiently to fit over the reverse spring body 124 and the hub 78 within its respective ends. This strain creates friction between the clutch spring 120 and the spring body 124, and also between the clutch spring 120 and the hub 78. This friction creates a drag force resisting rotation of the hub 78 relative to the spring body 124.

The separator element 76 is so arranged that the drag force provided by the clutch spring 120 is greater than the bias provided by the reverse spring 128, within the limits of rotation of the reverse spring body 124 relative to the hub pin 132.

The clutch spring 120 and the reverse spring 128 and the associated structure define the first drag 82 briefly mentioned above.

In operation, the assembly 76 as shown in FIGS. 7 and 8 has a two-stage action. When the hub 78 is rotated to a limited degree, the rotation force is transmitted via the hub 78, the clutch spring 120, and the spring body 124, to the reverse spring 128. During this limited rotation, the hub 78, the clutch spring 120, and the spring body 124 turn as a unit, since the clutch spring 120 engages too tightly to permit slipping. The rotation of the hub 78 thus strains the reverse spring 128, and rotates the spring body 124 against its spring bias. The limit of this rotation occurs when the upper abutment 144 abuts and thus is stopped by the hub pin 132. At this point the recoil mechanism is fully cocked, meaning that it has absorbed all the rotation energy it is designed to hold.

The hub 78 can be further rotated beyond the limit at which the upper abutment 144 abuts the hub pin 132. If this occurs, the reverse spring body 124 is stopped against the hub pin 132, and will not rotate further. The hub 78 and the hub 78 thus are rotating, while the reverse spring body 124 is stopped. The clutch spring 120 creates a drag between the hub 78 and the reverse spring body 124 during this further rotation. This drag force will continue as long as the further rotation continues with sufficient force to keep the upper abutment 144 stopped against the hub pin 132. Should the turning force diminish below this threshold force at any time, the bias of the reverse spring will cause the spring body to recoil, rotating back toward its starting position at which the lower abutment 142 is in contact with the hub pin 132.

When the roller sleeve 88 is in contact with a single sheet that is being driven by a drive roller forming a nip, the friction between the single sheet and the sleeve 88 is sufficient to transmit the driving force via the sleeve 88, the hub 78, and so forth to the reverse spring body 124. The reverse spring body is wound to the point where the upper abutment 144 is against the hub pin 132, and further rotation forward is allowed, with a drag force, by the clutch spring 120. As long as the sleeve 88 is either in contact with the single sheet or with the drive roller (as between two sheets fed successively), the separator is devised so rotation of the sleeve, with the present drag, continues.

If, however, a multifeed of two or more sheets is introduced into the nip, the low friction between the sheets interrupts the transmission of driving force from the driving roller (here, the infeed roller 28) to the sleeve 88. When this force is removed, the reverse spring 128 recoils, quickly rotating the sleeve 88 on its hub 78 and backing up the nearest sheet of the multifeed. So long as the multifeed remains in the nip, the reverse spring 128 is strong enough to keep the roller sleeve from rotating. The friction of the roller sleeve 88 against the nearest sheet of the multifeed prevents that sheet from moving forward while the sheet driven by the drive roller keeps going forward. This action separates the multifeed, and continues to do so as long as more than one sheet is disposed in the nip.

Returning to FIGS. 3–5, the assembly of the two hubs 78 and 80 and the sleeve 88 turns as a unit on the shaft 84, and this rotation is resisted by the combined dragging force of the first and second drags 82 and 86. Thus, as illustrated schematically in FIGS. 9–13 (for the roller 24) and described below, the roller sleeve 88 of the separator roller 24 is rotated by a sheet driven along the sheet path and engaging the outer surface of the roller sleeve 88. The rotating roller sleeve 88 in turn rotates the rotatable elements 78 and 80. Rotation of the rotatable elements 78 and 80 is retarded by the drags. If multiple sheets are driven the reverse spring recoils. The net result is that the sheet separator assembly retards the forward progress of the second surface of any multifeed, separating the multifeed.

It will be appreciated that the double drag mechanism shown in FIGS. 4 and 7–8 is not essential, as a single drag mechanism could be provided.

Figure 9:
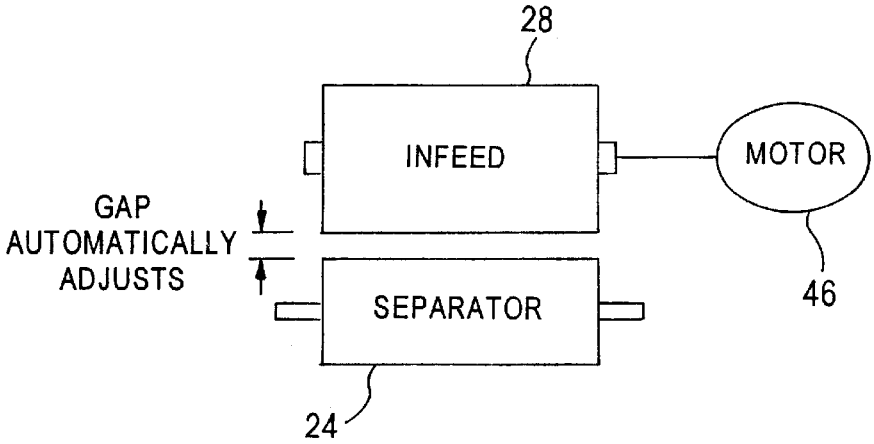
FIG. 9 is a diagrammatic illustration of the advancing drive and separator arrangement of the present invention.

The operation of the separator of the present sheet feeder is shown in FIGS. 9–13. FIG. 9 shows a block diagram of the relation between an infeed roller 28, a separator roller 24, a driven shaft 72, and a friction clutch 82 representing the operation of internal structure of the separator roller 24 as described above. An infeed roller 28 and its drive 46 are also shown.

Figure 10:
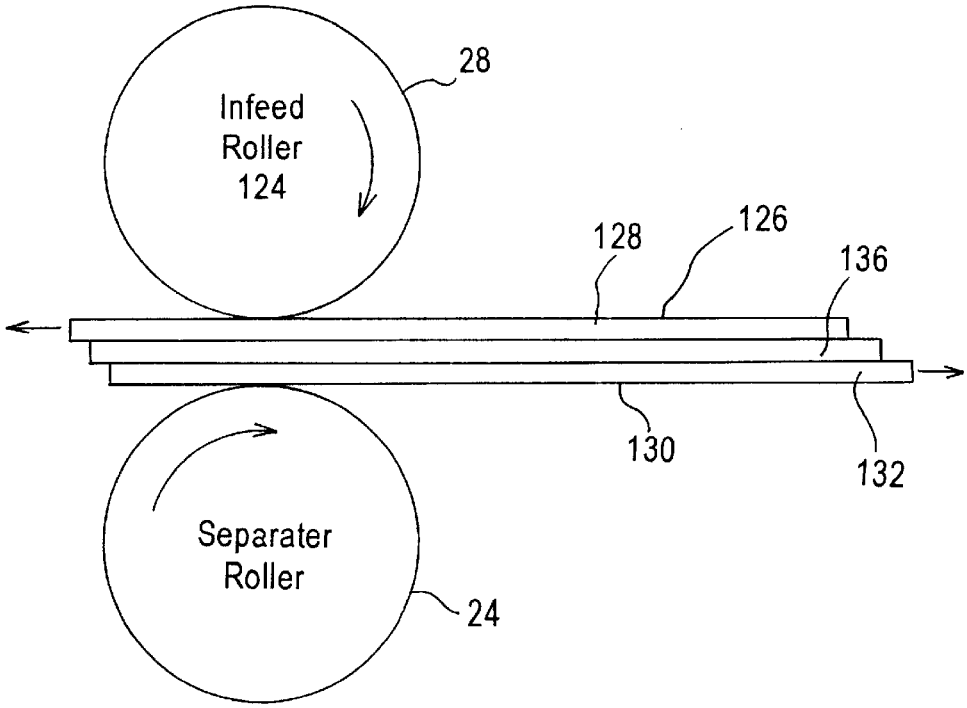
FIG. 10 is a diagrammatic illustration of the presentation of a multifeed of three sheets to the sheet separator according to the present invention.

Referring to FIG. 10, the infeed roller 28 is positioned to drive forward (by rotating in the direction of the arrow 124) the first surface 126 of a sheet 128 in the sheet path defined between the rollers 24 and 28. The sheet 128 is driven to the left, or forward, as a result. The separator roller 24 is positioned to drag on the second surface 130 of a sheet 132 in the sheet path.

FIGS. 10–13 illustrate how a multifeed of three sheets is progressively broken down into individual sheets by the present separator. In FIG. 10, a multifeed including sheets 128, 136, and 132 has been inserted between the infeed roller 28 and the separator roller 24. The infeed roller 28 drives the top sheet 128 forward, as the friction between the top sheet 128 and the roller 28 is greater than the friction between the top sheet 128 and middle sheet 136 of the multifeed. The separator roller 24 drives the bottom sheet 132 backward to the limit allowed by its recoil mechanism, as the friction between the bottom sheet 132 and the roller 24 is greater than the friction between the bottom sheet 132 and the middle sheet 136.

Figure 11:
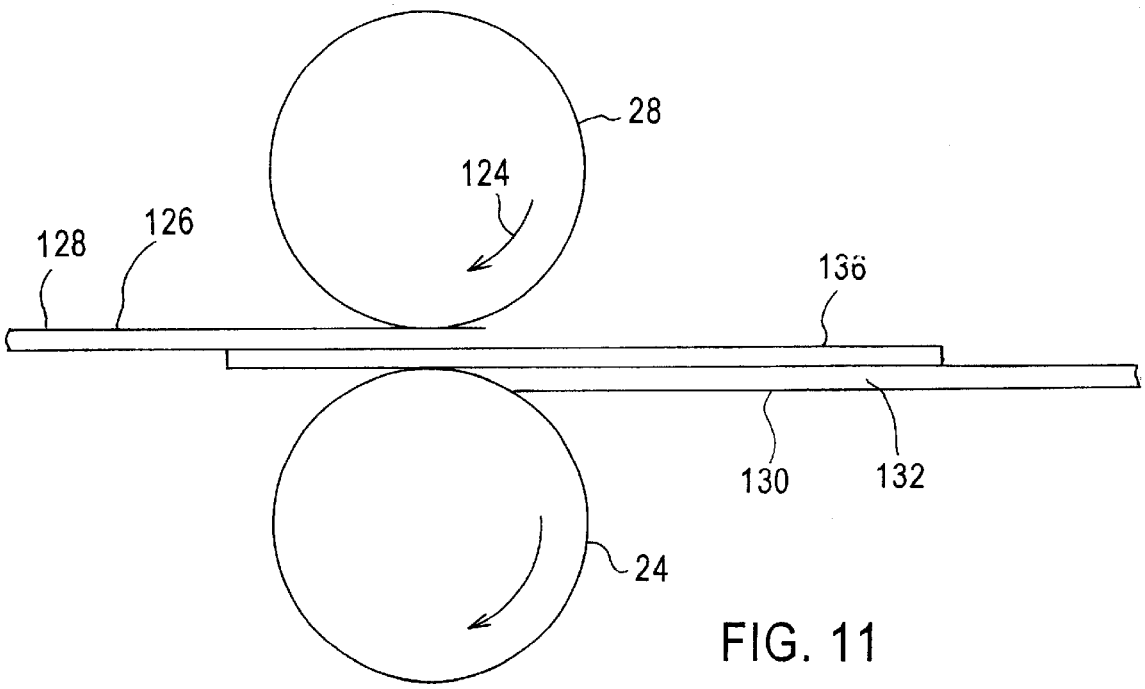
FIG. 11 is a view similar to FIG. 10, showing the multifeed partially separated by operation of the sheet separator.
Figure 12:
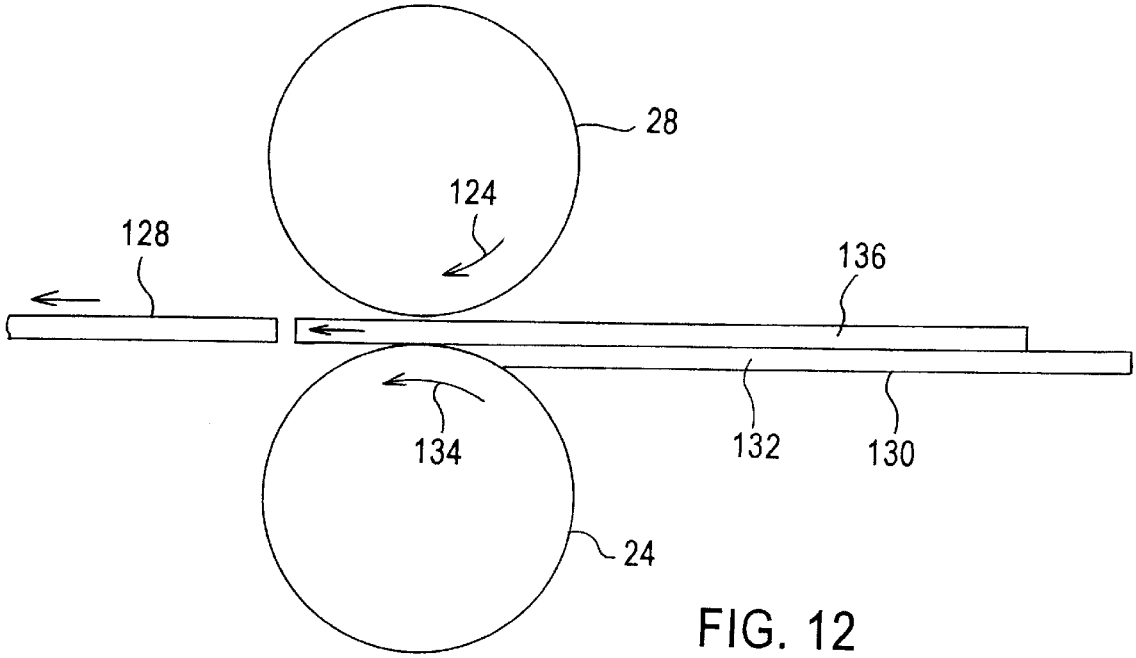
FIG. 12 is a view similar to FIG. 11, showing the multifeed further separated by operation of the sheet separator.

The top sheet 128 is advancing, the bottom sheet 132 is retreating, and the middle sheet 136 moves very little or travels with one of the sheets 132 and 136. Thus, the multifeed is broken up into three shingled (or in some instances entirely non-overlapping sheets), as shown in FIG. 11. As illustrated, the top sheet 128 and the middle sheet 136 define a two-sheet multifeed at this point. The two-sheet multifeed is readily separated by the counter-rotating infeed roller 28 and separator roller 24, leading to the situation shown in FIG. 12. Here, the sheet 128 is completely downstream of the separator made up of the rollers 28 and 24. The sheet 136 that was next in the original stack is now the top sheet engaged between the rollers 24 and 28. Thus, the first sheet 128 has been fully separated and advanced and the multifeed has been temporarily broken down to leave a single sheet 136 between the rollers 24 and 28.

Once the multifeed has been reduced to a single sheet between the rollers 24 and 28, the single sheet 136 is engaged with approximately equal friction by the rollers 24 and 28. The infeed roller 28 is thus again able to drive the separator roller 24 forward, in the direction of the arrow 134, causing the friction clutch 82 to slip and thus eliminate the separator action of the separator roller 24. The sheet 136 advances at the rate dictated by the rotation of the infeed roller 28.

Figure 13:
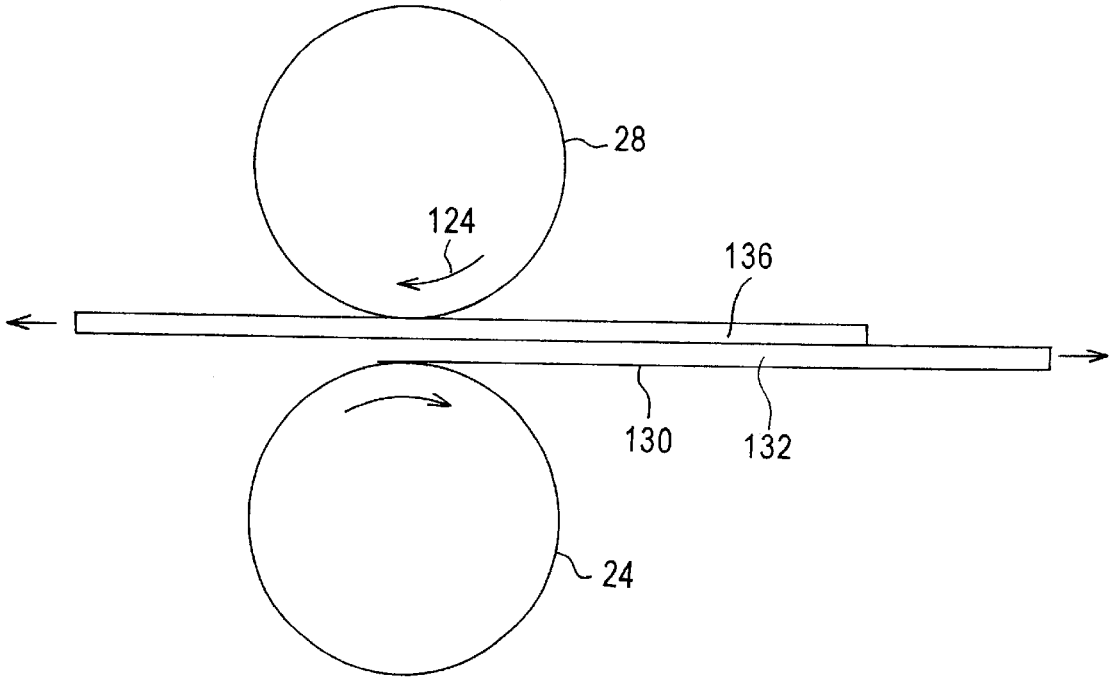
FIG. 13 is a view similar to FIG. 12, showing the multifeed still further separated by operation of the sheet separator.

If the sheets 136 and 132 again form a multifeed between the rollers 24 and 28, as shown in FIG. 13, the drive coupling between the rollers 24 and 28 is again broken by the interposition of two sheets, 136 and 132. The friction clutch 82 again engages and the separator roller 24 is again driven backward to the limit allowed by the recoil mechanism, driving back the bottom sheet 132.

The foregoing detailed description of the present invention has been described by reference to specific embodiments, and the best mode contemplated for carrying out the present invention has been shown and described. It should be understood, however, that modifications or variations in the structure and arrangement of other than those specifically set forth herein may be achieved by those skilled in the art. Any and all such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is limited only by the limitations of a particular claim that is under study.

What is claimed is:

1. A sheet separating assembly for breaking down multifeeds of two or more overlapping sheets into separate sheets, the separator comprising:

(a) a sheet path along which a multifeed of at least two sheets can be passed, the multifeed having first and second opposed outside surfaces;

(b) an advancing drive positioned to engage and drive the first surface of the multifeed in a feed direction along said sheet path;

(c) a plurality of rotatable separator rollers each adapted for rotation by the second surface of the multifeed, said plurality of rotatable separator rollers each being mounted for independent rotation in the feed direction and the counterfeed direction;

(d) a plurality of recoil mechanisms each associated with a respective rotatable separator roller of said plurality of rotatable separator rollers, each of said plurality of recoil mechanisms for accepting rotational energy, for biasing said respective separator roller to rotate in the counterfeed direction, when said respective separator roller is rotated in the feed direction by advancement of the second surface of the multifeed in the feed direction; and (e) a drag to resist rotation of said plurality of separator rollers in the feed direction responsive to forward movement of said multifeed.

2. The sheet separating assembly of claim 1, wherein said drag is a spring clutch.

3. The sheet separating assembly of claim 1, further comprising a replaceable roller sleeve having an outer, generally cylindrical surface positioned to frictionally engage the second surface of the multifeed and an inner, generally cylindrical surface engaging said plurality of rotatable separator rollers.

4. The sheet separating assembly of claim 1 wherein said plurality of rotatable separator rollers are coaxial with and axially displaced from one another.

5. The sheet separating assembly of claim 1 wherein said drag includes a plurality of drags, each associated with one of said plurality of rotatable separator rollers for forward rotation of a respective second separator roller responsive to forward movement of said multifeed.

6. The sheet separating assembly of claim 3, wherein said roller sleeve is axially slidable on said plurality of rotatable separator rollers configured for ready installation on and removal from said separator rollers.

7. The sheet separator assembly of claim 1, wherein a drag includes a plurality of drags, each coupled to a respective recoil mechanism of said plurality of recoil mechanisms.

8. A sheet separator for use in sheet separating assembly for breaking down multifeeds of two or more overlapping sheets, the assembly advancing a multifeed having a first and a second opposed outside surfaces in a feed direction along a sheet path, the sheet separator comprising:

(a) a plurality of rotatable separator rollers each adapted for rotation by the second surface of the multifeed, said plurality of rotatable separator rollers each being mounted for independent rotation in the feed direction and the counterfeed direction; (b) a plurality of recoil mechanisms each associated with a respective rotatable separator roller of said plurality of rotatable separator rollers, each of said plurality of recoil mechanisms for accepting rotational energy, for biasing said respective separator roller to rotate in the counterfeed direction, when said respective separator roller is rotated in the feed direction by advancement of the second surface of the multifeed in the feed direction, each recoil mechanism comprising a drag to resist rotation of said respective separator rollers in the feed direction responsive to forward movement of said multifeed; and (c) a replaceable roller sleeve having an outer, generally cylindrical surface positioned to frictionally engage the second surface of the multifeed and an inner, generally cylindrical, surface engaging said plurality of rotatable separator rollers.

9. The sheet separator of claim 8, wherein said replaceable roller sleeve is axially slidable on said plurality of rotatable separator rollers configured for ready installation on and removal from said separator rollers.

* * * * *